United States Patent [19]

Schuettenberg et al.

[11] Patent Number: 4,722,767

[45] Date of Patent: Feb. 2, 1988

[54] ALKYL POLYOXYALKYLENE SULFIDES AND ALKYL POLYOXYALKYLENE SULFOXIDES AS LUBRICATING ADDITIVES

[75] Inventors: Alexander Schuettenberg; Merlin R. Lindstrom; R. P. Louthan; Bernard A. Baldwin, all of Bartlesville, Okla.; Gary D. Macdonell, Louisville, Ky.

[73] Assignee: Phillips Petroleum Company, Bartlesville, Okla.

[21] Appl. No.: 853,791

[22] Filed: Apr. 18, 1986

[51] Int. Cl.[4] ..... C01M 135/08; C01M 135/24

[52] U.S. Cl. ..... 252/48.2; 252/45.0; 252/48.6; 252/49.3; 252/49.5

[58] Field of Search ..... 252/48.2, 45.0, 49.3, 252/49.5

[56] References Cited

U.S. PATENT DOCUMENTS 4,255,561 3/1981 Wood et al. ..... 525/403

4,663,082 5/1987 Bobsein et al. ..... 252/174.21

*Primary Examiner*—Ferris H. Lander

*Assistant Examiner*—Ellen McAvoy

*Attorney, Agent, or Firm*—Williams, Phillips & Umphlett

[57] ABSTRACT

A water soluble lubricating additive for water-based fluids used in metalworking operations comprising a polyoxyalkylene sulfur compound selected from the group consisting of alkyl polyoxyalkylene sulfides, alkyl polyoxyalkylene sulfoxides and mixtures thereof. In an alternate embodiment of this invention, dithiodiglycol may be combined with a polyoxyalkylene sulfur compound selected from the group consisting of alkyl polyoxyalkylene sulfides, alkyl polyoxyalkylene sulfoxides and mixtures thereof to produce said water soluble lubricating additive.

35 Claims, No Drawings

ALKYL POLYOXYALKYLENE SULFIDES AND ALKYL POLYOXYALKYLENE SULFOXIDES AS LUBRICATING ADDITIVES

This invention relates to compositions used in metalworking operations. In one aspect, this invention relates to compositions which are useful as lubricating additives for water-based fluids used in metalworking operations. In another aspect, this invention relates to compositions which are useful as extreme pressure (EP) lubricating additives for water-based fluids used in metalworking operations.

In metalworking operations, such as cutting, drilling, drawing, tapping, polishing, grinding, turning, milling and the like, it is customary to flood the tool and the work piece with a coolant for the purpose of carrying off heat which is produced during the operation. Such coolants are typically water-based or are based upon liquid organic compounds.

In addition to carrying off heat which is produced during metalworking operations, however, it is also desirable that the fluids used in such operations be capable of reducing friction between the tool and the work piece. Typically, the coolants used in metalworking operations do not possess either lubricity (low load) or extreme pressure (high load) lubricating properties. Therefore, it is customary to employ these coolants in combination with various lubricating additives which do possess such properties.

In addition to lubricating additives, however, many other additives are also used to provide water-based metalworking fluids with various desirable characteristics. Thus, such a water-based fluid will typically contain, among other additives, small amounts of at least one lubricity additive, an extreme pressure additive, a rust controlling additive, a pH buffering additive, a corrosion inhibitor, and a biocide. Therefore, the lubricating additives used in a water-based metalworking fluid are preferably water soluble, and thus suitable for use in a water-based fluid without the presence of an emulsifier, and compatible with other commonly used additives.

It is thus an object of this invention to provide water soluble lubricating additives which, when added to water-based fluids used in metalworking operations, enhance the lubricating characteristics of such fluids and are compatible with other additives commonly used with such fluids.

In accordance with the present invention, a polyoxyalkylene sulfur compound selected from the group consisting of alkyl polyoxyalkylene sulfides, alkyl polyoxyalkylene sulfoxides and mixtures thereof is added to water-based fluids used in metalworking operations, thereby improving the lubricating characteristics of such fluids.

In an alternate embodiment of the invention, a polyoxyalkylene sulfur compound selected from the group consisting of alkyl polyoxyalkylene sulfides, alkyl polyoxyalkylene sulfoxides and mixtures thereof is combined with dithiodiglycol (also known as di-(2-hydroxyethyl) disulfide or diethanol disulfide) to produce a water soluble lubricating additive. When said additive is added to water-based fluids used in metalworking operations the lubricating characteristics of such fluids are improved.

Other objects and advantages of the invention will be apparent from the foregoing brief description of the invention and the appended claims as well as the detailed description of the invention which follows.

The lubricating additive of this invention comprises a polyoxyalkylene sulfur compound selected from the group consisting of alkyl polyoxyalkylene sulfides, alkyl polyoxyalkylene sulfoxides and mixtures thereof. Any suitable alkyl polyoxyalkylene sulfide may be used in accordance with this invention. Suitable alkyl polyoxyalkylene sulfides can be prepared by the reaction of an alkyl mercaptan and an alkylene oxide. A generic formula for a suitable alkyl polyoxyalkylene sulfide is as follows:

$$R—S—(R'O)_x—H$$

wherein R is a hydrocarbyl group having 1 to 20 (preferably 12) carbon atoms; R′ is a hydrocarbyl group having 1 to 5 (preferably 2) carbon atoms; and x=1 to 15 (preferably 3 to 12).

Examples of suitable alkyl polyoxyalkylene sulfides include: t-dodecyl polyoxyethylene sulfide, n-dodecyl polyoxyethylene sulfide, decyl polyoxyethylene sulfide, eicosyl polyoxyethylene sulfide, dodecyl polyoxypropylene sulfide, tetradecyl polyoxypropylene sulfide, octadecyl polyoxypropylene sulfide, decyl polyoxybutylene sulfide, dodecyl polyoxybutylene sulfide and undecyl polyoxybutylene sulfide. A preferred alkyl polyoxyalkylene sulfide is t-dodecyl polyoxyethylene sulfide with either seven (7) or nine (9) oxyethylene repeat units.

Any suitable alkyl polyoxyalkylene sulfoxide may be used in accordance with this invention. Suitable alkyl polyoxyalkylene sulfoxides may be prepared by oxidizing suitable alkyl polyoxyalkylene sulfides. A generic formula for a suitable alkyl polyoxyalkylene sulfoxide is as follows:

$$R—\overset{\overset{\displaystyle O}{\|}}{S}—(R'O)_x—H$$

where R, R′ and x are as previously defined.

Examples of suitable alkyl polyoxyalkylene sulfoxides include: t-dodecyl polyoxyethylene sulfoxide, n-dodecyl polyoxyethylene sulfoxide, decyl polyoxyethylene sulfoxide, eicosyl polyoxyethylene sulfoxide, dodecyl polyoxyethylene sulfoxide, tetradecyl polyoxypropylene sulfoxide, octadecyl polyoxypropylene sulfoxide, decyl polyoxybutylene sulfoxide, dodecyl polyoxybutylene sulfoxide and undecyl polyoxybutylene sulfoxide. A preferred alkyl polyoxyalkylene sulfoxide is t-dodecyl polyoxyethylene sulfoxide with either five (5) or nine (9) oxyethylene repeat units.

In an alternate embodiment of this invention, dithiodiglycol (also known as di-(2-hydroxyethyl) disulfide or diethanol disulfide) is combined with a polyoxyalkylene sulfur compound selected from the group consisting of alkyl polyoxyalkylene sulfides and alkyl polyoxyalkylene sulfoxides to form a water soluble lubricating additive. Dithiodiglycol, which is commercially available from both Phillips Chemical Company, Bartlesville, Okla. and Pennwalt Company, Philadelphia, Pa., may be prepared in accordance with the disclosure set forth in U.S. Pat. No. 4,250,046. Since dithiodiglycol is commercially available and may be prepared by conventional methods and since such preparation does not play any part in the present invention, the preparation of dithiodiglycol will not be more fully discussed hereinafter.

The dithiodiglycol and the polyoxyalkylene sulfur compound selected from the group consisting of alkyl polyoxyalkylene sulfides, alkyl polyoxyalkylene sulfoxides and mixtures thereof may be combined in any suitable manner and under any suitable conditions. Preferably, the disulfide and the polyoxyalkylene sulfur compound are mixed together using conventional mixing equipment until a substantially clear, homogenous composition is obtained. It is not believed that the conditions of mixing such as temperature or pressure have any effect on the formation of the composition. Optionally, water can be present in the composition.

Any suitable amount of dithiodiglycol may be present in the composition comprising dithiodiglycol and a polyoxyalkylene sulfur compound selected from the group consisting of alkyl polyoxyalkylene sulfides, alkyl polyoxyalkylene sulfoxides and mixtures thereof. Preferably, the concentration of the dithiodiglycol in said composition is in the range of about 5 weight-% to about 95 weight-% based upon the weight of the composition. More preferably, said concentration will be in the range of about 10 weight-% to about 50 weight-% based upon the weight of the composition.

The lubricating additives of the present invention may be utilized to improve either the lubricity (low load) or extreme pressure (high load) lubricating properties of any suitable water-based fluid used in metalworking operations.

Any suitable amount of the lubricating additives of this invention may be added to a water-based metalworking fluid. The amount added would generally be sufficient to result in a concentration of the lubricating additive in the water-based metalworking fluid in the range of about 0.01 weight-% to about 10 weight-% based upon the combined weight of the lubricating additive and the water-based fluid. More preferably, said concentration will be in the range of about 0.02 weight-% and about 2.0 weight-% based upon the combined weight of the lubricating additive and the water-based fluid.

In addition to the lubricating additives of the present invention, the water-based metalworking fluid may contain other other conventional additives such as additional lubricating additives, rust preventatives, pH modifiers, corrosion inhibitors and biocides. Such conventional additives do not play a part in the present invention, however, and they are well known in the art; therefore, they will not be more fully discussed hereinafter.

The following examples are presented in further illustration of the invention.

EXAMPLE I

This example illustrates the use of alkyl polyoxyethylene sulfoxides as lubricating additives in aqueous solutions. Several aqueous solutions were tested in a Falex EP (extreme pressure) test in accordance with ASTM D-3233. Each of the aqueous solutions tested contained about 0.8 weight-% of the indicated additive. The results of these tests are presented in Table I.

TABLE I

| Run | Solution | Fail Load (lbs) |
|---|---|---|
| 1 (Control) | water | 300 |

TABLE I-continued

| Run | Solution | Fail Load (lbs) |
|---|---|---|
| 2 (Invention) | t-dodecyl polyoxyethylene sulfoxide-5[a] | 4250 |
| 3 (Invention) | n-dodecyl polyoxyethylene sulfoxide-5 | 4000 |
| 4 (Invention) | n-butyl polyoxyethylene sulfoxide-6 | 500 |
| 5 (Invention) | t-dodecyl polyoxyethylene sulfoxide-7 | 3750 |
| 6 (Invention) | n-dodecyl polyoxyethylene sulfoxide-7 | 500[b] |
| 7 (Invention) | n-dodecyl polyoxyethylene sulfoxide-7 | 2000 |
| 8 (Invention) | n-dodecyl polyoxyethylene sulfoxide-7 | 2250 |
| 9 (Invention) | t-dodecyl polyoxyethylene sulfoxide-9 | 2500 |
| 10 (Invention) | n-dodecyl polyoxyethylene sulfoxide-9 | 3250 |
| 11 (Invention) | t-dodecyl polyoxyethylene sulfoxide-12 | 1000 |

[a]the number at the end of the solution description represents the number of ethylene oxide equivalents that were reacted with an alkyl mercaptan to form the preoxidation alkyl polyoxyethylene sulfide

[b]considered to be an anomalous result in view of runs 7 and 8

The test data presented in Table I demonstrates that alkyl polyoxyethylene sulfoxides are effective extreme pressure lubricating additives. The data also shows that an alkyl polyoxyethylene sulfoxide containing 5 oxyethylene repeat units (runs 2 and 3) is the most preferred lubricating additive.

EXAMPLE II

This example illustrates the use of alkyl polyoxyethylene sulfoxides and alkyl polyoxyethylene sulfides as lubricating additives in aqueous solutions containing other common additives such as a rust inhibitor, a biocide, a lubricity agent and an amine (for pH adjustment). The two aqueous solutions used in this example comprised the following additives:

Solution A:

- 0.8 wt-% triethanolamine, used for pH adjustment;
- 0.3 wt-% Synkad 500®, a carboxylic acid salt rust inhibitor, marketed by Keil Chemical; and,
- 0.05 wt-% Biopan P-1487®, a biocide marketed by Keil Chemical;

Solution B:

- 0.08 wt-% triethanolamine;
- 0.15 wt-% octanoic acid, used as a lubricity agent; and,
- 0.6 wt-% polypropylene glycol, used as a lubricity agent.

Solution A was combined with 0.8 weight-% of either an alkyl polyoxyethylene sulfoxide or an alkyl polyoxyethylene sulfide to form solutions which were then tested in a Falex EP test in accordance with ASTM D-3233. Likewise, Solution B was combined with varying amounts (as indicated below) of either an alkyl polyoxyethylene sulfide or an alkyl polyoxyethylene sulfoxide to form several solutions which were also tested in a Falex EP test. Both Solution A and Solution B were also tested. The results of these tests are presented in Table II.

TABLE II

| Run | Solution | Fail Load (lbs) |
|---|---|---|
| 12 (Control) | Solution A | 750 |
| 13 (Control) | Solution B | 2100 |
| 14 (Invention) | Solution A + t-dodecyl POE[a] sulfoxide-3 | 3500 |
| 15 (Invention) | Solution A + n-dodecyl POE sulfoxide-3 | 3750 |
| 16 (Invention) | Solution B'[b] + t-dodecyl POE sulfide-3 | 4250+ |

TABLE II-continued

| Run | Solution | Fail Load (lbs) |
|---|---|---|
| 17 (Invention) | Solution B''[c] + t-dodecyl POE sulfide-3 | 4250+ |
| 18 (Invention) | Solution A + t-dodecyl POE sulfoxide-5 | 3750 |
| 19 (Invention) | Solution A + n-dodecyl POE sulfoxide-5 | 3750 |
| 20 (Invention) | Solution A + t-dodecyl POE sulfide-7 | 3750 |
| 21 (Invention) | Solution B' + t-dodecyl POE sulfide-7 | 4250 |
| 22 (Invention) | Solution B'' + t-dodecyl POE sulfide-7 | 4250+ |
| 23 (Invention) | Solution B' + t-dodecyl POE sulfoxide-7 | 3800 |
| 24 (Invention) | Solution B'' + t-dodecyl POE sulfoxide-7 | 4250+ |
| 25 (Invention) | Solution A + t-dodecyl POE sulfoxide-9 | 2500 |
| 26 (Invention) | Solution A + n-dodecyl POE sulfoxide-9 | 3750 |
| 27 (Invention) | Solution B' + t-dodecyl POE sulfide-12 | 4250+ |
| 28 (Invention) | Solution B'' + t-dodecyl POE sulfide-12 | 4250+ |

[a]polyoxyethylene
[b]B' contains 0.5 weight % of the sulfoxide or sulfide additive
[c]B'' contains 2.0 weight % of the sulfoxide or sulfide additive The test data presented in Table II demonstrates that both alkyl polyoxyethylene sulfoxides and alkyl polyoxyethylene sulfides are effective extreme pressure lubricating additives in aqueous solutions containing various traditional additives.

EXAMPLE III

This example illustrates the use of alkyl polyoxyethylene sulfoxides as lubricating additives in aqueous solutions which contain an additional lubricating additive. The aqueous solutions, which were tested in a Falex EP test in accordance with ASTM D-3233, comprised 0.8 weight-% of each of the indicated additives. The results of these tests are presented in Table III.

TABLE III

| Run | Solution | Fail Load (lbs) |
|---|---|---|
| 29 (Control) | Actramide[a] | 3000 |
| 30 (Invention) | Actramide + n-dodecyl POE sulfoxide-5 | 4000 |
| 31 (Invention) | Actramide + t-dodecyl POE sulfoxide-9 | 3750 |
| 32 (Invention) | Actramide + n-dodecyl POE sulfoxide-9 | 3750 |

[a]Actramide 189; a lubricity agent, marketed by Arthur C. Trask Operation, The Southland Corporation Chemical Division, Chicago, Illinois The data presented in Table III demonstrates that alkyl polyoxyethylene sulfoxides are effective extreme pressure lubricating additives when added to an aqueous solution which already contains other lubricating additives. Based upon this data and the data set forth in Table II, it is believed that alkyl polyoxyethylene sulfides would also be effective extreme pressure lubricating additives in such solutions.

Furthermore, based upon this data and the data set forth in Table II, it is also believed that mixtures of alkyl polyoxyethylene sulfides and alkyl polyoxyethylene sulfoxides would be effective extreme pressure lubricating additives in aqueous solutions.

EXAMPLE IV

This example demonstrates the use of alkyl polyoxyethylene sulfoxides, in combination with dithiodiglycol ($HO—C_2H_4—S—S—C_2H_5—OH$; also known as di-(2-hydroxyethyl) disulfide and diethanol disulfide; marketed by Phillips Chemical Company, Bartlesville, Okla.), as a lubricating additive in aqueous solutions. The aqueous solutions, which were tested in a Falex EP test in accordance with ASTM D-3233, contained 0.8 weight-% of each of the indicated additives. The results of these tests are presented in Table IV.

TABLE IV

| Run | Solution | Fail Load (lbs) |
|---|---|---|
| 33 (Control) | dithidiglycol | 500 |
| 34 (Invention) | t-dodecyl POE sulfoxide-9 | 2500 |
| 35 (Invention) | dithidiglycol + t-dodecyl POE sulfoxide-9 | 3750 |
| 36 (Invention) | n-dodecyl POE sulfoxide-9 | 3250 |
| 37 (Invention) | dithidiglycol + n-dodecyl POE sulfoxide-9 | 4250 |

The data presented in Table IV demonstrates that the aqueous mixtures of dithiodiglycol and an alkyl polyoxyethylene sulfoxide are more effective lubricants than aqueous solutions of either component alone. Furthermore, by comparing the data of runs 33 and 34 with run 35 and runs 33 and 36 with run 37, it can be seen that the lubricating effectiveness of the aqueous mixtures of dithiodiglycol and an alkyl polyoxyethylene sulfoxide is more than merely the additive effectiveness of the two components alone. Based upon this data and the data presented in Table II, it is believed that an aqueous mixture of dithiodiglycol and either an alkyl polyoxyethylene sulfide or a mixture of an alkyl polyoxyethylene sulfide and a alkyl polyoxyethylene sulfoxide would also demonstrate this synergistic effect.

While this invention has been described in detail for the purpose of illustration, it is not to be construed as limited thereby but is intended to cover all changes and modifications within the spirit and scope thereof.

That which is claimed is:

1. A method for improving the lubricating properties of a water-based fluid used in metalworking operations comprising the step of adding to said water-based fluid a lubricating additive comprising a polyoxyalkylene sulfur compound selected from the group consisting of alkyl polyoxyalkylene sulfides, alkyl polyoxyalkylene sulfoxides and mixtures thereof.

2. A method in accordance with claim 1 wherein said polyoxyalkylene sulfur compound is an alkyl polyoxyalkylene sulfide.

3. A method in accordance with claim 2 wherein said alkyl polyoxyalkylene sulfide has the generic formula $$R—S—(R'O)_x—H$$

wherein R is a hydrocarbyl group having 1 to 20 carbon atoms, R' is a hydrocarbyl group having 1 to 5 carbon atoms x=1 to 15.

4. A method in accordance with claim 3 wherein R is a hydrocarbyl group having 12 carbon atoms, R' is a hydrocarbyl group having 2 carbon atoms and x=3 to 12.

5. A method in accordance with claim 1 wherein said polyoxyalkylene sulfur compound is an alkyl polyoxyalkylene sulfoxide.

6. A method in accordance with claim 5 wherein said alkyl polyoxyalkylene sulfoxide has the generic formula:

$$R-\overset{O}{\overset{\|}{S}}-(R'O)_x-H$$

wherein R is a hydrocarbyl group having 1 to 20 carbon atoms, R' is a hydrocarbyl group having 1 to 5 carbon atoms and x=1 to 15.

7. A method in accordance with claim 6 wherein R is a hydrocarbyl group having 12 carbon atoms, R' is a hydrocarbyl group having 2 carbon atoms and x=3 to 12.

8. A method in accordance with claim 1 wherein said polyoxyalkylene sulfur compound is a mixture of an alkyl polyoxyalkylene sulfide and an alkyl polyoxyalkylene sulfoxide.

9. A method in accordance with claim 1 wherein a sufficient amount of said lubricating additive is added to said water-based fluid to result in a concentration of said lubricating additive in said water-based fluid in the range of about 0.01 weight-% to about 10 weight-% based upon the combined weight of said lubricating additive and said water-based fluid.

10. A method in accordance with claim 9 wherein said concentration is in the range of about 0.02 weight-% to about 1.0 weight-% based upon the combined weight of said lubricating additive and said water-based fluid.

11. A method in accordance with claim 1 wherein said lubricating additive additionally comprises dithiodiglycol.

12. A method in accordance with claim 11 wherein the concentration of dithiodiglycol in said lubricating additive is in the range of about 5.0 weight-% to about 95 weight-% based upon the combined weight of said lubricating additive and said dithiodiglycol.

13. A method in accordance with claim 12 wherein said concentration is in the range of about 10 weight-% to about 50 weight-% based upon the combined weight of said lubricating additive and said dithiodiglycol.

14. A method in accordance with claim 11 wherein a sufficient amount of said lubricating additive is added to said water-based fluid to result in a concentration of said lubricating additive in said water-based fluid in the range of about 0.01 weight-% to about 10 weight-% based upon the combined weight of said lubricating additive and said water-based fluid.

15. A method in accordance with claim 14 wherein said concentration is in the range of about 0.02 weight-% to about 2.0 weight-% based upon the combined weight of said lubricating additive and said water-based fluid.

16. A method for producing a lubricating additive comprising the step of combining dithiodiglycol and a polyoxyalkylene sulfur compound selected from the group consisting of alkyl polyoxyalkylene sulfides, alkyl polyoxyalkylene sulfoxides and mixtures thereof to produce said lubricating additive.

17. A method in accordance with claim 16 wherein said polyoxyalkylene sulfur compound is an alkyl polyoxyalkylene sulfide.

18. A method in accordance with claim 17 wherein said alkyl polyoxyalkylene sulfide has the generic formula $$R-S-(R'O)_x-H$$

wherein R is a hydrocarbyl group having 1 to 20 carton atoms, R' is a hydrocarbyl group having 1 to 5 carbon atoms and x=1 to 15.

19. A method in accordance with claim 18 wherein R is a hydrocarbyl group having 12 carbon atoms, R' is a hydrocarbyl group having 2 carbon atoms and x=3 to 12.

20. A method in accordance with claim 16 wherein said polyoxyalkylene sulfur compound is an alkyl polyoxyalkylene sulfoxide.

21. A method in accordance with claim 20 wherein said alkyl polyoxyalkylene sulfoxide has the generic formula:

$$R-\overset{O}{\overset{\|}{S}}-(R'O)_x-H$$

wherein R is a hydrocarbyl group having 1 to 20 carbon atoms, R' is a hydrocarbyl group having 1 to 5 carbon atoms and x=1 to 15.

22. A method in accordance with claim 21 wherein R is a hydrocarbyl group having 12 carbon atoms, R' is a hydrocarbyl group having 2 carbon atoms and x=3 to 12.

23. A method in accordance with claim 16 wherein said polyoxyalkylene sulfur compound is a mixture of an alkyl polyoxyalkylene sulfide and an alkyl polyoxyalkylene sulfoxide.

24. A method in accordance with claim 16 wherein the concentration of dithiodiglycol in said lubricating additive is in the range of about 5.0 weight-% to about 95 weight-% based upon the weight of said lubricating additive.

25. A method in accordance with claim 24 wherein said concentration is in the range of about 10 weight-% to about 50 weight-% based upon the weight of said lubricating additive.

26. A composition comprising dithiodiglycol and a polyoxyalkylene sulfur compound selected from the group consisting of alkyl polyoxyalkylene sulfides, alkyl polyoxyalkylene sulfoxides and mixtures thereof.

27. A composition in accordance with claim 26 wherein said polyoxyalkylene sulfur compound is an alkyl polyoxyalkylene sulfide.

28. A composition in accordance with claim 27 wherein said alkyl polyoxyalkylene sulfide has the generic formula $$R-S-(R'O)_x-H$$

wherein R is a hydrocarbyl group having 1 to 20 carton atoms, R' is a hydrocarbyl group having 1 to 5 carbon atoms and x=1 to 15.

29. A composition in accordance with claim 28 wherein R is a hydrocarbyl group having 12 carbon atoms, R' is a hydrocarbyl group having 2 carbon atoms and x=3 to 12.

30. A composition in accordance with claim 29 wherein said polyoxyalkylene sulfur compound is an alkyl polyoxyalkylene sulfoxide.

31. A composition in accordance with claim 30 wherein said alkyl polyoxyalkylene sulfoxide has the generic formula:

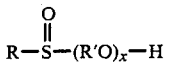

wherein R is a hydrocarbyl group having 1 to 20 carbon atoms, R′ is a hydrocarbyl group having 1 to 5 carbon atoms and x=1 to 15.

32. A composition in accordance with claim 31 wherein R is a hydrocarbyl group having 12 carbon atoms, R′ is a hydrocarbyl group having 2 carbon atoms and x=3 to 12.

33. A composition in accordance with claim 26 wherein the said polyoxyalkylene sulfur compound is a mixture of an alkyl polyoxyalkylene sulfide and an alkyl polyoxyalkylene sulfoxide.

34. A composition in accordance with claim 26 wherein the concentration of dithiodiglycol in said composition is in the range of about 5.0 weight-% to about 95 weight-% based upon the weight of said composition.

35. A composition in accordance with claim 34 wherein said concentration is in the range of about 10 weight-% to about 50 weight-% based upon the weight of said composition.

* * * * *